US005494276A

United States Patent [19]

Faber et al.

[11] Patent Number: 5,494,276

[45] Date of Patent: Feb. 27, 1996

[54] METHOD AND APPARATUS FOR SHINGLING DOCUMENTS

[75] Inventors: Thomas Faber, Skokie; Kenneth L. Guenther, Park Ridge; Joseph Kalika, Niles; K. George Rabindran, Morton Grove, all of Ill.

[73] Assignee: Bell & Howell Company, Skokie, Ill.

[21] Appl. No.: 176,966

[22] Filed: Jan. 3, 1994

[51] Int. Cl.[6] ..... B65H 3/32

[52] U.S. Cl. ..... 271/113; 271/126; 271/150; 271/184; 271/225

[58] Field of Search ..... 271/31.1, 109, 271/126, 129, 149, 150, 151, 184, 225, 113

[56] References Cited

U.S. PATENT DOCUMENTS

| | | | |
|---|---|---|---|
| 5,092,574 | 3/1992 | Braen et al. | 271/150 X |
| 5,219,432 | 6/1993 | Delbe et al. | 271/31.1 X |
| 5,297,785 | 3/1994 | Ricciardi | 271/150 X |
| 5,299,797 | 4/1994 | Ricciardi | 271/150 |

OTHER PUBLICATIONS

Rabindran et al., Back to Basics On Flats Feeding, Nov. 30, 1992, Advanced Technology Conference Handout relevant pp. 21–22, 30.

*Primary Examiner*—William E. Terrell
*Assistant Examiner*—Carol L. Druzbick
*Attorney, Agent, or Firm*—Welsh & Katz, Ltd.

[57] ABSTRACT

Apparatus for shingling a plurality of documents disposed in stacked relation so that the stack extends successively from a first end to a second end, and has at least one boundary defined by substantially coplanar marginal edges of the documents. The stack of documents is conveyed along a predetermined path during which one or more rotatable shingling members engage the coplanar marginal edges of the documents and impart velocity components of progressively increasing magnitude to the marginal edges in a manner to effect movement of the documents into a shingled array. In the preferred embodiments, the rotatable shingling member has a conical shingling surface traversed by the documents in tangential relation so that the velocity components imparted to the marginal edges of the documents lie in the planes of the documents and move them laterally in shingled relation to each other.

9 Claims, 4 Drawing Sheets

METHOD AND APPARATUS FOR SHINGLING DOCUMENTS

BACKGROUND OF THE INVENTION

The present invention relates generally to document handling systems, and more particularly to a novel method and apparatus for shingling a stack of documents as they are fed toward a singulating station.

It is a common practice in the automated handling of documents, such as mailing envelopes and flats, to progressively feed a stack of documents in a feeder station or magazine to a singulating station from which the documents are fed as separated single documents to a sorting station or other processing station. To better prepare the stacked documents for singulating, means are conventionally provided to shingle the documents prior to their entering the singulating station. Shingling results in orienting either the top or bottom document in a vertical stack, or the front or lead document in an on-edge stack, so that the forward or leading edge of each successive top, bottom or front document is disposed slightly forwardly or laterally of the leading edge of the next adjacent document, preferably by a distance of approximately one inch. By shingling the stacked documents, only one document at a time will enter the nip defined by singulating belts or rollers, thereby substantially reducing the possibility that more than one document at a time will be fed simultaneously through the singulating belts or rollers.

Prior techniques for shingling on-edge stacked documents include passive shingling wherein a triangular shaped plate is disposed over a flat feed belt disposed transverse to the feed direction of the stack of on-edge documents so that each document is exposed to progressively greater belt contact as the document is fed toward the singulating station. The increasing belt contact applies a progressively greater friction force to the lower edge of each successive document so that each document is advanced or shingled relative to the next successive document in the direction of movement of the transverse belt.

A prior technique for shingling a stack of generally horizontally disposed vertically stacked or face-up documents employs a series of rollers disposed transverse to the feed direction of the stack. The rollers rotate at progressively increasing rotational speeds which causes the lowermost document to be accelerated and advanced relative to the next above document in the stack. A drawback to this technique is that the transverse rollers engage a flat lower surface of the lowermost document and effectively drive one document at a time. Also, the driving force created by the rollers is dependent upon the weight of the stack and the coefficient of friction between the stacked documents.

A variation to differentially driven roller type shinglers is to vibrate the rollers while they are driven at substantially the same rotational speeds so as to create a jogging and jerky acceleration action on the stack. This causes the upper documents in the stack to fall back and thereby create a shingled relation between adjacent documents.

Another prior technique for shingling a stack of documents employs suction or vacuum means to advance each successive document in a vertical or on-edge stack into the nip of a belt or roller type singulating station. A significant disadvantage of suction or vacuum type shingling mechanisms is that they are particularly sensitive to the thickness and relative stiffness of the documents. Also, depending on the porosity of the documents, more than one document at a time may be advanced or shingled relative to the remaining documents. This results in more than one document at a time being fed into the nip of the singulating belts or rollers.

Another prior document shingling technique which finds particular application with on-edge stacks of documents is the use of in-line spiral feeders having variable pitch to separate the leading document or a small group of documents from the rest of the stack. The separated document or small grouping of documents may then be lightly fed against a transverse feed belt capable of moving each successive lead document in shingled relation laterally into the nip of a singulator station which forwards the documents in singulated fashion. Again, however, this technique may result in more than one document at a time being fed simultaneously into the singulating station in nonshingled relation.

Thus, a shingling method and apparatus which significantly increases the efficiency of shingling a stack of on-edge documents so that the leading edge of a single document at a time is introduced into the nip of singulating rollers or belts would greatly improve the rate at which documents could be handled in a document handling system.

SUMMARY OF THE INVENTION

A general object of the present invention is to provide a novel method and apparatus for shingling a stack of documents as they are fed into a singulating station.

A more particular object of the present invention is to provide a novel method and apparatus for shingling a stack of documents as they are fed along a predetermined path, wherein the lower marginal edges of the documents are engaged in a manner to impart a differential velocity component to each stacked document in a direction to move each document in its own plane and effect shingling between the leading edges of the documents in the stack.

In carrying out the present invention, a stack of documents is fed along a predetermined path in a manner to establish generally coplanar marginal edges of the stacked documents. The coplanar marginal edges of the stacked documents are caused to engage one or more shingling members operative to impart velocity components of varying magnitude along the marginal edges of the documents so as to arrange the documents in a shingled array. In preferred embodiments, the marginal edges of the stacked documents are caused to engage rotating shingling members in tangential point contact. The rotating shingling members impart to each individual document a velocity component of progressively increasing magnitude as the documents are advanced along the predetermined feed path. Each successive lead document in the stack is fed laterally at a greater velocity than the next successive document so that shingling is effected between the leading edges of successive documents.

A feature of the document shingling method and apparatus in accordance with the present invention lies in engaging the lower marginal edges of the on-edge stacked documents with one or more rotating shingling members configured so that the documents traverse each rotating member along a surface line of contact having a progressively increasing radius from its rotational axis, whereby to impart a progressively increasing velocity component to the marginal edge of each document as it is advanced along the predetermined feed path.

Another feature of the document shingling method and apparatus in accordance with the present invention lies in providing various embodiments and orientations of rotating shingling members so that the lower marginal edges of the stacked documents engage generally conical drive surfaces on the rotating shingling members and traverse the drive surfaces along lines of contact operative to impart progressively increasing velocity components to the documents through tangential point contact, and wherein the velocity components lie in the planes of the documents which in turn are substantially transverse to the path traversed along the shingling members.

Another feature of the document shingling apparatus of the present invention lies in the use of rotatably driven guide rollers which are engaged by successive lead documents in the stack so that the lead document is maintained in generally upstanding relation as it is moved transversely by the rotating shingling members.

The present invention provides a document handling apparatus capable of applying at least three different force elements to the marginal bottom edges of documents in a stack to obtain shingling or separation of the documents from the stack. First, the documents in the stack are advanced until the marginal bottom edges of the documents initiate contact with the conical drive surface on the rotating shingling members. A transverse velocity component perpendicular to the direction of advancement of the stack of documents is imparted to the bottom edge of each document as it contacts the rotating shingling member. Initial contact takes place at a point that is toward the center of the rotating discs and the velocity is minimal. This allows a smooth transition as the documents change direction to approach the singulation at the end of the array of conical drive surfaces. A maximum shingling affect is applied to the lead document of the stack at this point in the document conveying process, since the second document in the stack is still being held against lateral movement by the magazine feed belts which advance the document stack towards the rotating shingling members.

Second, as the stack of documents is advanced onto the rotating shingling members, the bottom edges of the multiple documents proceed to come into contact with the conical drive surfaces of the shingling members. As a result of the difference in tangential velocity along a line from the center to the outer edge of the conical drive surfaces, an additional shingling effect is imparted to each document due to the constantly changing velocity where the document edges contact the rotating conical surfaces.

Third, the shingling apparatus of the present invention may comprise a plurality of rotating conical surfaces in a linear array extending at right angles to the direction the stack of documents is being advanced toward the array of conical surfaces, wherein the conical surfaces each rotate at a higher circular velocity than the immediately preceding conical surface. The speed differential of the conical surfaces can be varied to control and define the shingling effect, i.e.: the amount of overlap of the trailing edge of each document over the leading edge of the subsequent adjacent document. In this mode of operation, the speed differential between sequential rotating conical surfaces can be set to produce no overlap between successive documents conveyed by the discs, which results in total separation of each document relative to each subsequent adjacent document coming off the stack. Also, total separation may be achieved by rotating the conical surfaces at the same circular speed, and lengthening the disc path to the point where total separation between adjacent documents is achieved.

Further objects, features and advantages of the present invention, together with the organization and manner of operation thereof, will become apparent from the following detailed description of the invention taken in conjunction with the accompanying drawings wherein like reference numerals designate like elements throughout the several views.

DETAILED DESCRIPTION

Figure 1:
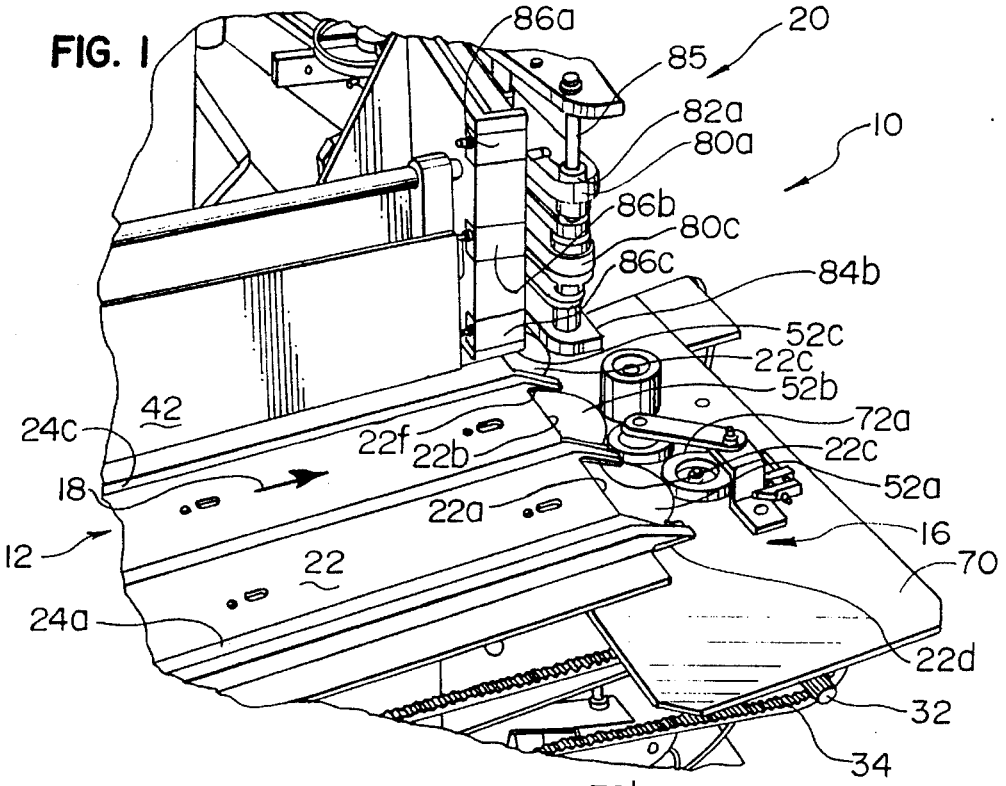
FIG. 1 is a fragmentary perspective view of a document handling system for feeding generally upstanding on-edge documents to a singulating station, and employing shingling apparatus in accordance with one embodiment of the present invention.
Figure 2:
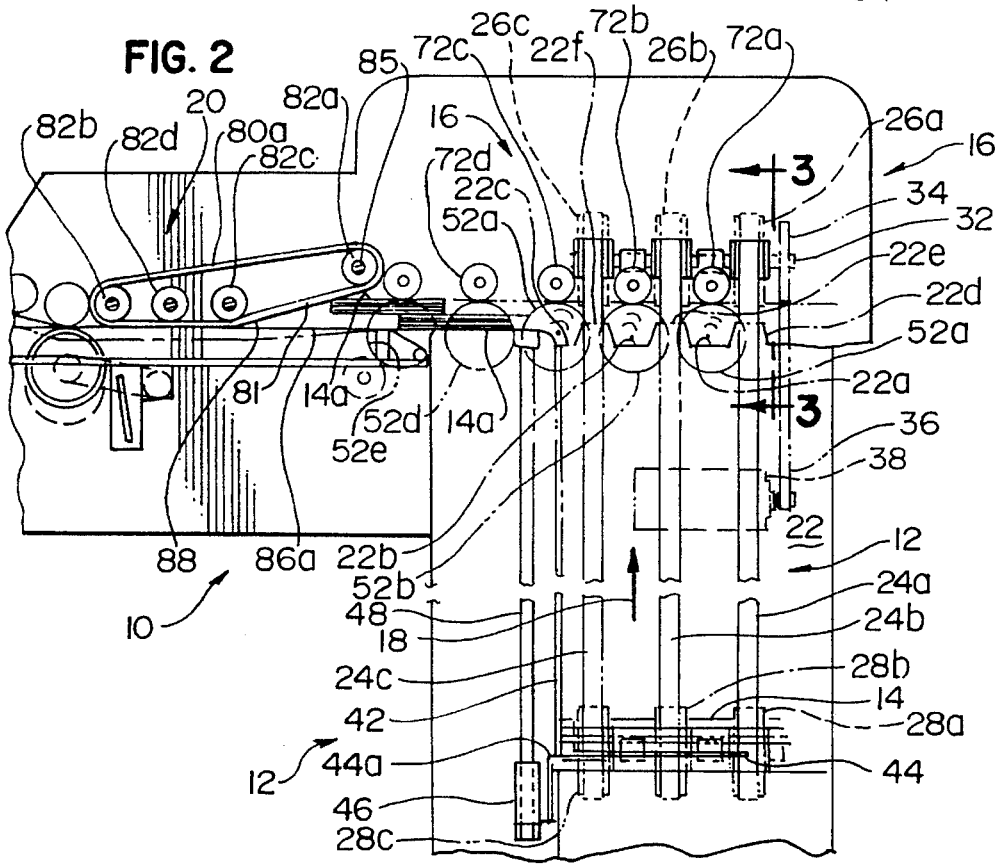
FIG. 2 is a fragmentary plan view of the in-feed conveyor, shingling apparatus and singulating station illustrated in FIG. 1 but with portions broken away for clarity.

Referring now to the drawings, and in particular to FIGS. 1 and 2, a fragmentary portion of a document handling system for handling stacked documents is indicated generally at 10. The document handling system 10 includes a document feed station or magazine, indicated generally at 12, adapted to receive a stack of documents, such as indicated at 14 (FIG. 2), and feed the documents to a shingling apparatus 16. The documents 14 may comprise mailing envelopes of conventional personal or commercial letter size, or "flats" which are mail pieces generally between approximately 7½×10½ inches and 11½×14½ inches along their edges, and up to approximately ¾ inch thick or more, such as magazines, catalogs, large envelopes, and the like. In the illustrated embodiment, the stacked documents 14 are supported in generally upstanding on-edge relation and are fed along the feed station 12 in the direction of arrow 18 while disposed generally transverse to their feed direction. Upon reaching the shingling apparatus 16, the documents are moved laterally in substantially their own planes by the shingling apparatus so as to feed the documents in shingled fashion to a singulating station 20. The singulating station 20 is operative to feed the documents downstream from the singulating station in a singulated or one-at-a-time manner to a sorting or other document handling station. A document reader station (not shown) may be disposed downstream from the singulating station 20 for reading mailing address indicia or the like on each document, such as a bar code or alphanumeric address, for ultimate sorting purposes.

The document feed station or magazine 12 is of conventional design and includes an upwardly inclined generally rectangular planar base plate 22 which supports the upper reaches of a plurality of parallel endless feeder or conveyors belts, three of which are indicated at 24*a*, 24*b* and 24*c* in FIGS. 1 and 2. The feeder belts 24*a–c* are each reeved about a corresponding forward drive pulley or roller, indicated at 26*a*, 26*b* and 26*c*, and a corresponding rearward idler pulley or roller 28*a–c*. Preferably, the outer exposed surfaces of the feeder belts 24*a–c* are transversely serrated or grooved, or comprise high-friction surfaces, for positive engagement with lower marginal edges of the transverse documents 14 when disposed in generally upstanding on-edge relation on the base plate 22 for feeding in the direction of arrow 18 to firmly hold the bottom edge of the documents in contact with feeder belts 24*a–c*.

The feeder belt drive pulleys 26*a–c* are fixed on a common drive shaft 32 having a drive pulley 34 fixed on an end thereof. The drive pulley 34 cooperates with suitable drive means, such as an endless drive belt 36 driven by a drive motor 38 to effect selective constant or intermittent rotation of the feeder belt drive pulleys 26*a–c*.

A vertically disposed guide plate 42 is fixed in upstanding relation on the base plate 22 parallel to the feeder belts 24*a–c* and serves as a left-hand margin or guide surface against which the generally vertical left-hand marginal edges of the documents 14 may abut, as illustrated in FIG. 2. A pusher or pressure plate 44 is supported in transverse relation to the feeder belts 24*a–c* by a bracket 44*a* mounted on a guide sleeve 46 which in turn is slidable along a cylindrical guide shaft 48 disposed parallel to the guide plate 42 and spaced above the base plate 22. A suitable handle (not shown) may be fixed to the pusher plate 44 or the associated bracket 44*a* to enable pivotable movement of the pusher plate about the axis of the guide shaft 48 and manual movement along the axial length of guide shaft 48. When initially stacking a plurality of documents 14 in upstanding relation on the feed station base plate 22, the operator preferably manually jogs the documents to engage the vertical left-hand marginal edges of the documents against the guide plate 42.

As illustrated in FIGS. 1 and 2, the forward end of the document feed conveyor base plate 22 has a plurality of recesses formed therein so as to establish generally transversely aligned edge surfaces 22*a*, 22*b* and 22*c* between downwardly inclined forward extensions 22*d, e* and *f*, respectively, of the base plate. The base plate extensions 22*d, e* and *f* are coplanar and underlie downwardly inclined reaches of the feeder belts 24*a*, 24*b* and 24*c* as best seen in FIG. 1. As the lower marginal edge of each successive document 14 in a stack of documents being advanced along the base plate 22 traverses the downwardly inclined extensions 22*d–f* of the base plate, each lower marginal document edge engages shingling drive means in the form of a plurality of transversely aligned rotatable shingling members or discs, such as indicated at 52*a*, 52*b* and 52*c*.

Figure 3:
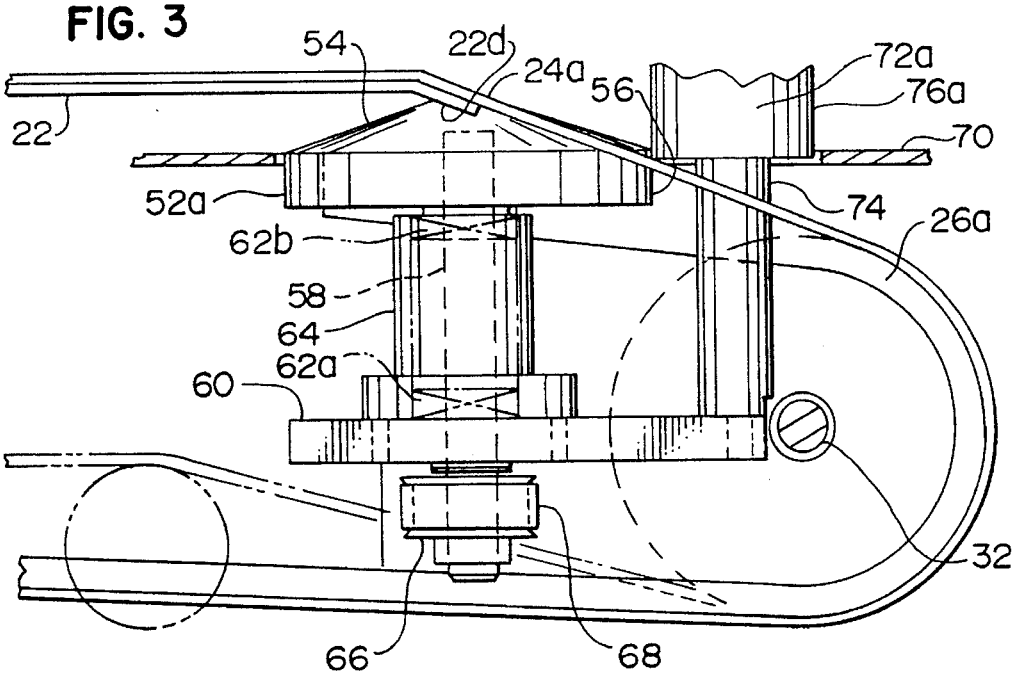
FIG. 3 is a fragmentary vertical sectional view taken substantially along line 3—3 of FIG. 2.

Referring to FIG. 3, taken in conjunction with FIGS. 1 and 2, the rotatable shingling members or discs 52*a–c* are supported for rotation about substantially vertical axes which lie in a common plane transverse to the document feeder belts 24*a–c*. With the shingling member or disc 52*a* of FIG. 3 being representative of all of the rotatable shingling members illustrated in FIGS. 1–3, the shingling member 52*a* comprises a circular disc having an upper conical drive or shingling surface 54 and a peripheral cylindrical surface 56. The shingling member 52*a* is fixed in coaxial relation on the upper end of a cylindrical drive shaft 58 which is supported in vertical relation on a support plate 60 by a pair of annular bearings 62*a* and 62*b* and a cylindrical sleeve 64. The drive shaft 58 extends below the support plate 60 and has a suitable drive pulley 66 secured thereon. The support plate 60 supports the shingling members or discs 52*b* and 52*c* in substantially identical fashion to the shingling member 52*a*. An endless drive belt 68 is reeved about the drive pulleys 66 on the vertical drive shafts for the respective shingling members 52*a–c* and is coupled to drive means in the form of a drive motor (not shown) adapted to effect simultaneous rotation of the shingling members at predetermined equal rotational speeds. If it is desired to rotate shingling members 52*a–c* at relatively different speeds, each shaft 58 could be coupled to a plurality of different sized pulleys 66, as is known in the art.

The shingling members or discs 52*a–c* are supported so that their upper conical surfaces 54 extend through suitable openings in a plate member 70 of the shingling apparatus 16 and are partially exposed within the respective recesses in the base plate 22 defined by the edge surfaces 22*a–c* and the forward base plate extensions 22*d–f*. In the embodiment illustrated in FIGS. 1–3, the upper conical surfaces 54 have an included angle at their apex of approximately 140°. Stated alternatively, the conical surfaces 54 have a conical pitch of approximately 20°, considered as the included angle between a straight line on the conical surface lying in a plane containing the rotational axis of each shingling member, and a plane transverse to the rotational axis. The forward projections 22*d–f* on base plate 22 are inclined downwardly such that as the lower marginal edges of the documents 14 descend the forward projections 22*d–f* on the feeder belts 24*a–c*, the lower edges engage the upper conical surfaces 54 on the shingling members 52*a–c* after passing beyond a vertical plane containing the rotational axes of the shingling members. As the lower marginal edges of the documents engage the rotating conical drive surfaces 54, the documents traverse the conical drive surfaces along relatively linear or straight paths with their lower marginal edges in substantially point contact with the rotating conical drive surfaces.

As each successive document 14 traverses the conical drive surfaces 54, the shingling members impart velocity components of varying magnitude to the lower marginal edges of the documents and effect movement of successive documents into a shingled array, as shown at 14*a* in FIG. 2. More particularly, as the lower marginal edges of the documents 14 traverse the conical drive surfaces 54, the shingling members impart a velocity vector or force component of progressively increasing magnitude to the lower edge of each successive document as these documents are pushed forward onto the conical drive surfaces 54 by the magazine belts 24*a–c*. Such progressively increasing velocity or force components lie substantially in the planes of the documents and impart lateral movement to each document in a plane substantially transverse to the conveyor belts 24*a–c*. The progressively increasing velocity components imparted to each document in the advancing stack cause the documents to be moved laterally out of the stack at progressively increasing velocities as they advance farther from the apexes of the conical drive surfaces. This produces differential lateral movement between successive documents which causes the lateral lead edges of the documents to be shingled relative to each other.

Referring to FIG. 2, two additional shingling members, indicated at 52*d* and 52*e*, are supported in laterally aligned relation with the shingling members 52*a–c*. The shingling members 52*d* and 52*e* are substantially identical to the shingling members 52*a–c* and are supported for rotation about vertical rotational axes in substantially the same manner as shingling member 52*a* illustrated in FIG. 3. The shingling members 52*d* and 52*e* are preferably rotatably driven by the drive belt 68 at the same rotational speeds as the shingling members 52*a–c*. If desired, shingling members 52*d* and 52*e* can be rotated at different speeds, as described previously. The geometry of the shingling members 52*a–e* is preferably such that each successive lead document in the stack will have its upstanding lateral edge shingled relative to the next adjacent document by approximately one inch as the lead document leaves the shingling member 52*e*. In the preferred embodiment, the shingling members 52*a–e* may be made of a suitable metallic material. The conical drive or shingling surfaces 54 preferably have a plastic coating thereon, such as a urethane plastic or other suitable high friction surface.

Referring again to FIGS. 1 and 3, as the documents 14 traverse the conical drive surfaces 54 on the shingling members 52*a–c*, the forward upstanding surface of each successive lead document may engage a plurality of rotatable guide rollers 72*a–c*. In the preferred embodiment, the guide rollers 72*a–c* are rotatably driven in synchronized relation with the corresponding shingling members 52*a–c* so that the guide rollers assist in maintaining the documents in generally upstanding relation as the documents are fed transversely to the singulating station 18 without creating a surface drag on the lead document. As illustrated in FIG. 3, each of the guide rollers 72*a–c* comprises a generally cylindrical roller rotatably supported in coaxial relation on a vertically upstanding support shaft such as indicated at 74 for guide rollers 72*a*. The support shafts 74 are in turn fixed to and supported by the support plate 60 such that the rotational axes of the guide rollers or rollers are parallel to the vertical rotational axes of the corresponding shingling members 52*a–c* and lie in a vertical plane parallel to the conveyor path 18 and parallel to a vertical plane containing the rotational axes of the corresponding shingling members.

The guide rollers 72*a–c* have outer cylindrical surfaces 76*a–c*, respectively, which engage and are driven by the annular cylindrical surface on the corresponding shingling member, such as indicated at 56 in FIG. 3. In this manner, the outer cylindrical surfaces 76*a–c* on the guide rollers have a tangential velocity equal to the tangential velocity of the outer cylindrical surface 56 on the corresponding shingling member. The guide rollers 72*a–c* impart a lateral velocity component to the forward surface of each successive lead document 14 which is substantially equal to the magnitude of the maximum velocity component imparted to the lower marginal edge of the lead document by the corresponding shingling members 52*a–c*. Similarly, a pair of guide rollers 72*d* and 72*e* are operatively associated with each of the shingling members 52*d* and 52*e* in similar fashion to the guide rollers 72*a–c* to assist in guiding the documents 14 laterally as they engage the conical drive surfaces 54 on the shingling members 52*d* and 52*e* by not allowing the documents to advance past the outer edge of the discs.

Referring again to FIGS. 1 and 2, the singulating station 20 includes a pair of parallel endless singulating belts 80*a* and 80*b* which are reeved about corresponding pairs of rollers 82*a* and 82*b* carried on a carriage having a lower plate 84. Pairs of similar size idler rollers 82*c* and 82*d* cooperate with the singulating belts 80*a* and 80*b* to define belt reaches disposed transverse to the feeder belts 24*a–c* and adjacent and downstream of inclined belt reaches positioned to be engaged by the leading edges of the documents 14 fed from the shingling station or apparatus 16. A plurality of generally stationary high friction flat belts, such as indicated at 86*a–c*, are supported so as to define with the singulating belts 80*a,b* a nip 88 into which the shingled leading edges of the laterally moving documents 14 are fed by the inclined reaches 81 of the singulating belts 80*a,b*. The singulating belts 80*a,b* are driven at a greater linear velocity than the velocity imparted to the documents 14 by the shingling members 52*a–e* so that the shingled documents will feed through and discharge from the singulating station 20 in single document fashion.

Figure 4:
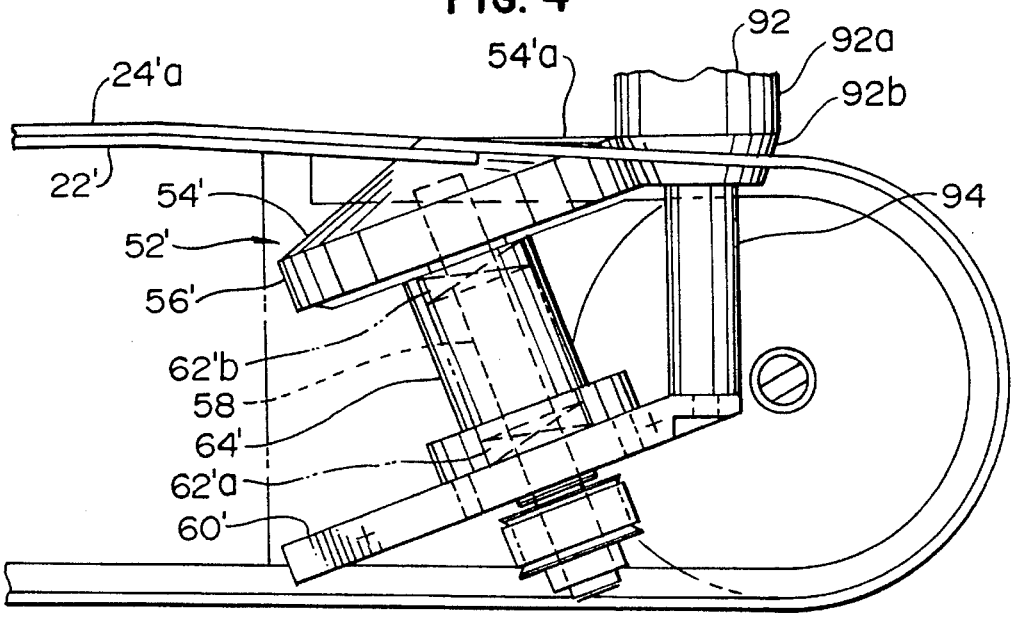
FIG. 4 is a fragmentary vertical sectional view similar to FIG. 3 but illustrating an alternative embodiment wherein the conical singulating member is rotatable about an axis inclined to vertical.

FIG. 4 illustrates an alternative manner of supporting the rotatable shingling members or discs 52*a–e* of FIGS. 1–3 so that the lower marginal edges of the documents 14 are maintained on a generally horizontal plane as they traverse the conical drive surfaces on the shingling members. A rotatable shingling member or disc 52' is shown in FIG. 4 having a conical drive surface 54' and a cylindrical peripheral surface 56'. The shingling member 52' is supported on the upper end of a drive shaft 58' which is rotatably supported by a support plate 60' through bearings 62'*a* and 62'*b* and a sleeve 64' in similar fashion to the aforedescribed shingling member 52*a*. The support plate 60' is inclined to horizontal so that the conical drive surface 54' is substantially tangent to a horizontal plane passing through the apex of the conical surface 54', as indicated by surface element 54'*a* in FIG. 4.

A guide roller 92 having an outer cylindrical surface 92*a* is supported for rotation about a vertical axis by a support shaft 94 fixed on the support plate 60'. The roller 92 has a beveled lower annular surface 92*b* in driven surface engagement with the annular cylindrical surface 62' on the shingling member 52'. In this manner, the lower marginal edges of a stack of generally upstanding on-edge documents being fed along a base plate 22' by a plurality of conveyor belts, one of which is indicated at 24'*a* in FIG. 4, traverse the conical drive surfaces 54' of a plurality of laterally aligned shingling members 52' in substantially point contact. The conical drive surfaces 54' impart to the lower marginal edge of each document a velocity component acting in the plane of the document and which increases in magnitude as the document traverses the conical drive surfaces from adjacent the apexes to the outer peripheries of the conical drive surfaces. With a plurality of shingling members or discs 52' supported in laterally aligned relation transverse to the conveyor belts on the in-feed station 12, the upstanding lateral or leading edge of each successive lead document is shingled relative to the leading edge of the next successive document in the stack as the documents are moved laterally by the shingling members to a singulating station, in a manner similar to that shown at 14*a* in FIG. 1.

Figure 5:
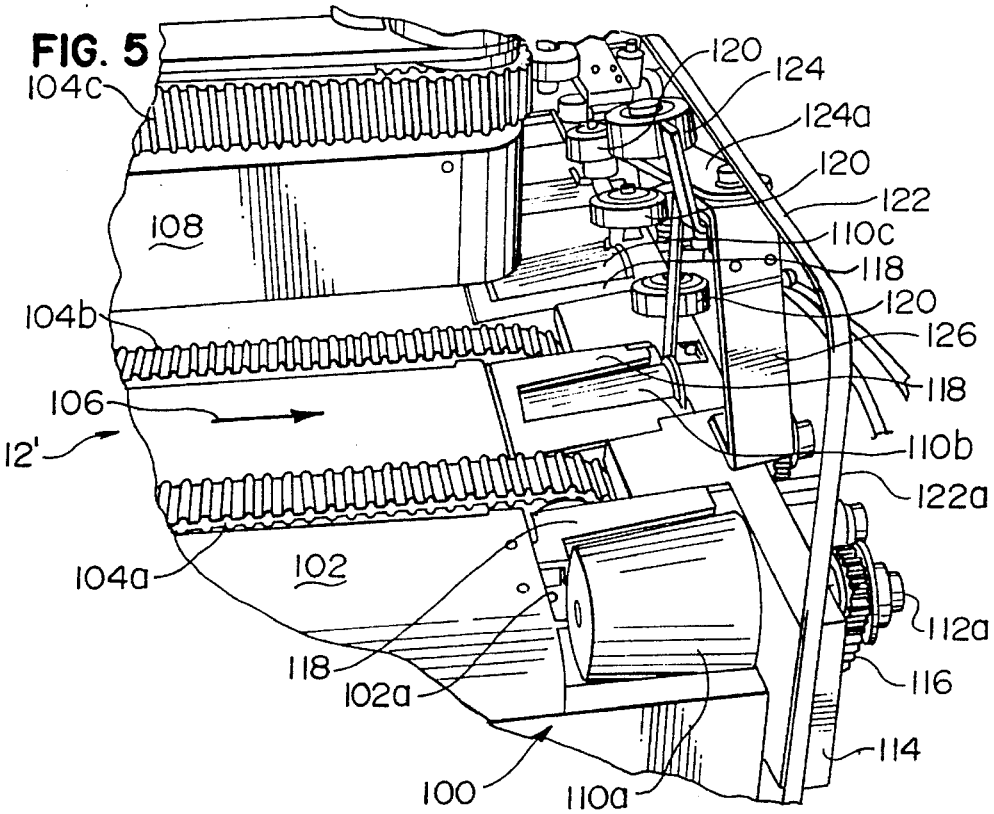
FIG. 5 is a fragmentary perspective view illustrating a document in-feed conveyor or magazine in cooperation with document shingling apparatus constructed in accordance with an alternative embodiment of the invention.
Figure 6:
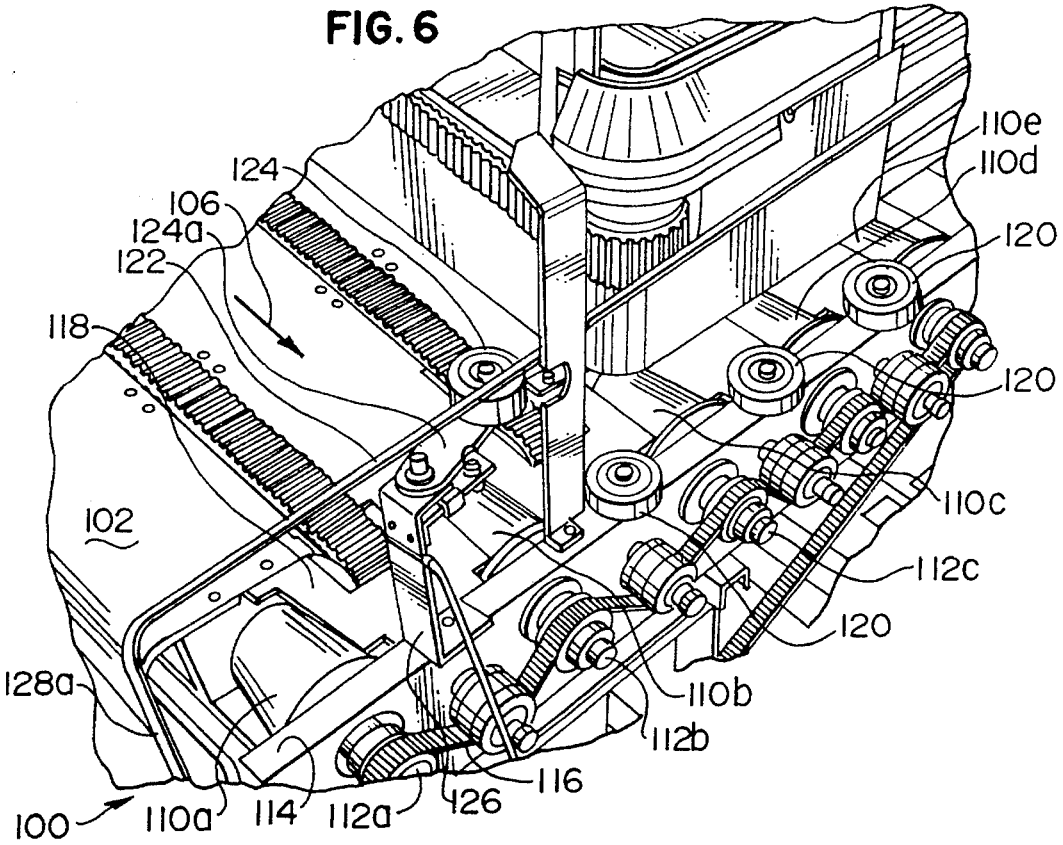
FIG. 6 is a fragmentary perspective view illustrating the drive means for the rotatable shingling members of FIG. 5.

FIGS. 5 and 6 illustrate an alternative embodiment of a shingling apparatus or station, indicated generally at 100, which is cooperative with a document feed station or magazine 12' similar to the aforedescribed feed station 12. The shingling apparatus or station 100 is operative to receive documents 14 from the feed station 12' and move successive lead documents laterally in shingled relation toward a singulating station such as station 20 in FIGS. 1 and 2. The document feed station or magazine 12' includes a base plate 102 along which the upper reaches of a pair of transversely serrated parallel conveyor belts 104*a* and 104*b* are guided, the conveyor belts being reeved about suitable drive and idler pulleys to enable selective movement of the conveyor belts in the direction of arrow 106. An upstanding wall 108 serves as a marginal side or guide plate for engagement with the upstanding left-hand lateral edges of documents, such as mailing envelopes and/or flats which are fed in the direction of arrow 106 by the conveyor belts 104*a,b* while the documents are disposed transverse to the longitudinal axes of the conveyor belts. An endless transversely serrated conveyor belt 104*c* may be supported so as to define a reach generally coplanar with the guide plate 108. The conveyor belt 104*c* cooperates with the conveyor belts 104*a* and 104*b* to convey a plurality of documents along the base plate 102 while disposed in upstanding on-edge relation, and to maintain taller documents in a vertical position as the conveyor belts 104*a*, 104*b* and 104*c* advance the documents toward the shingling station 100.

The shingling apparatus 100 includes a plurality of identical generally frustoconical shaped rotatable shingling members 110*a*, 110*b* and 110*c* which are positioned at the forward end of the feed station base plate 102, such that the rotatable shingling members are rotatable about parallel substantially coplanar horizontal axes. Each of the frustoconical shingling members 110*a–c*, which may alternatively be defined as being generally conical, is supported on a corresponding horizontal drive shaft, indicated at 112*a*, 112*b* and 112*c*, respectively, which extends through and is rotatably supported by a generally vertically orientated support plate 114. Each of the drive shafts 112*a–c* has a similar drive pulley fixed thereon about which is reeved an endless drive belt 116 (FIG. 6) cooperative with a drive motor (not shown) to effect selective equal rotation of the shingling members 110*a–c* in a clockwise direction, as viewed FIG. 6.

The rotatable shingling members 110*a,b* and *c* are supported such that the smaller diameter ends of the frustoconical shingling members are adjacent a forward edge 102*a* on the base plate 102. An upwardly inclined ramp plate 118 is fixed to the forward edge 102*a* of the base plate 102 and is configured to cause the lower marginal edges of documents being conveyed by the conveyor belts 102*a* and 102*b* to engage and traverse the frustoconical drive surfaces on the shingling members 110*a–c*. The lower marginal edges of the documents traverse the shingling members 110*a–c* in tangential point contact such that a progressively increasing velocity component is imparted to the lower marginal edge of each document as it traverses the shingling members from their smaller diameter ends to their larger diameter ends. The progressively increasing velocity components or vectors lie substantially in the planes of the documents and cause each document traversing the shingling members to be moved laterally at a progressively increasing speed. This causes the upstanding leading lateral edge of each document to be shingled relative to the leading edge of the next successive document. The conical drive or shingling surfaces peripherally of the shingling members 110*a–c* may also have a urethane coating thereon to provide a desired frictional relation with the lower marginal edges of the documents being shingled.

A plurality of guide rollers in the form of idler rollers 120 are supported on the upper edge of the support plate 114 so that the lower portion of the front surface of each successive document in the advancing stack engages and is guided by the guide rollers as the document is moved laterally by the shingling members 110*a–c*. A generally horizontal stop or guide bar 122 having a vertical leg 122*a* is supported by the support plate 114 to engage and guide the upper portion of each successive lead document as it is moved laterally by the shingling members 110*a–c*.

In the embodiment illustrated in FIGS. 5 and 6, a document sensor member in the form of a roller 124 is mounted on a pivot arm 124*a* which in turn is pivotally supported on an upstanding bracket 126. The sensor roller 124 is biased to a position forwardly of a vertical plane tangent to the guide rollers 120 and is moved rearwardly in response to documents detected on the shingling rollers 110*a–c*. The sensor roller 124 is connected in a control circuit (not shown) for the feeder conveyor belts 104*a* and 104*b* so as to stop the advancing movement of the feeder conveyor belts when documents are no longer detected on the shingling rollers; for example, when a stack of documents has been fully fed through the shingling station 100.

In similar fashion to the shingling station 16 of FIGS. 1 and 2, the shingling station 100 of FIGS. 5 and 6 has an additional pair of generally frustoconical rotatable shingling members 110*d* and 110*e* which are identical to the shingling members 110*a–c* and are supported in horizontal and lateral alignment with the shingling members 110*a–c*. The shingling members 110*d,e* are rotatably driven by the drive belt 116 and serve to continue lateral movement and shingling of documents initially moved laterally by the shingling members 110*a–c*. Guide rollers 120 are associated with the shingling members 110*d,e* to assist in lateral movement of the shingled documents as they are fed to a singulating station, such as the aforedescribed singulating station 20.

Figure 7:
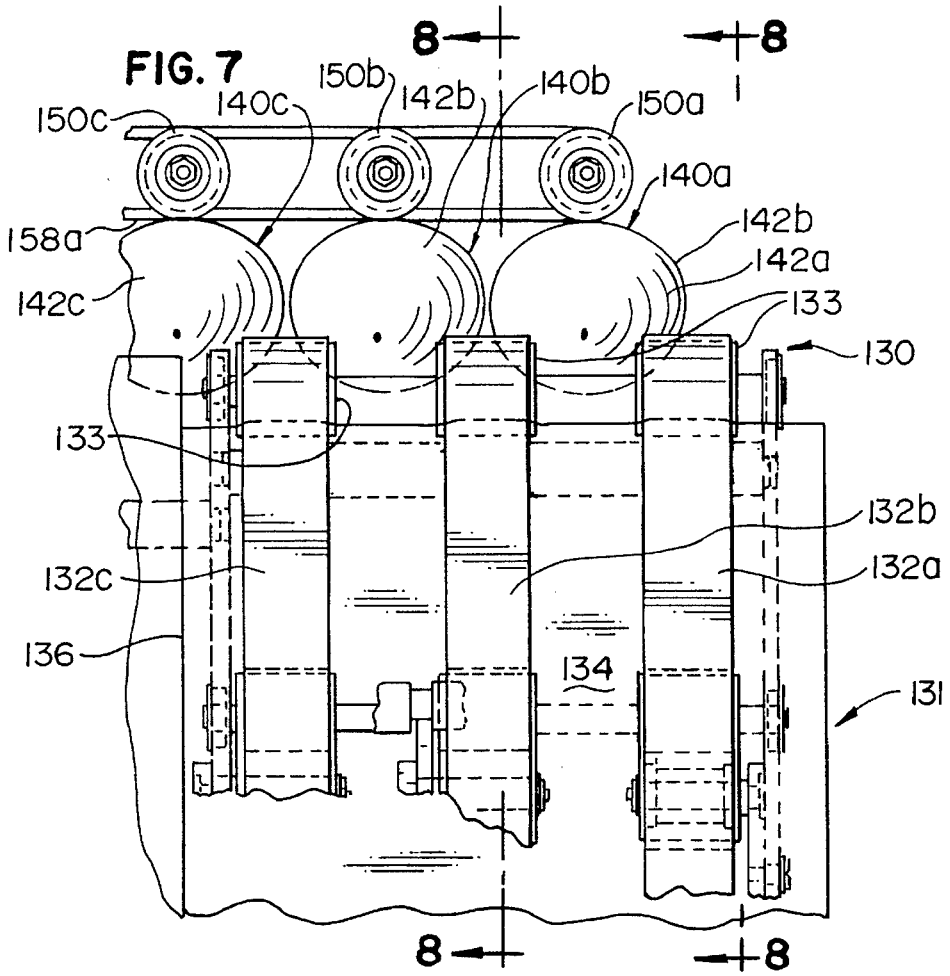
FIG. 7 is a fragmentary plan view illustrating another alternate embodiment of a document shingling apparatus in accordance with the present invention in cooperation with a document in-feed conveyor or magazine.
Figure 8:
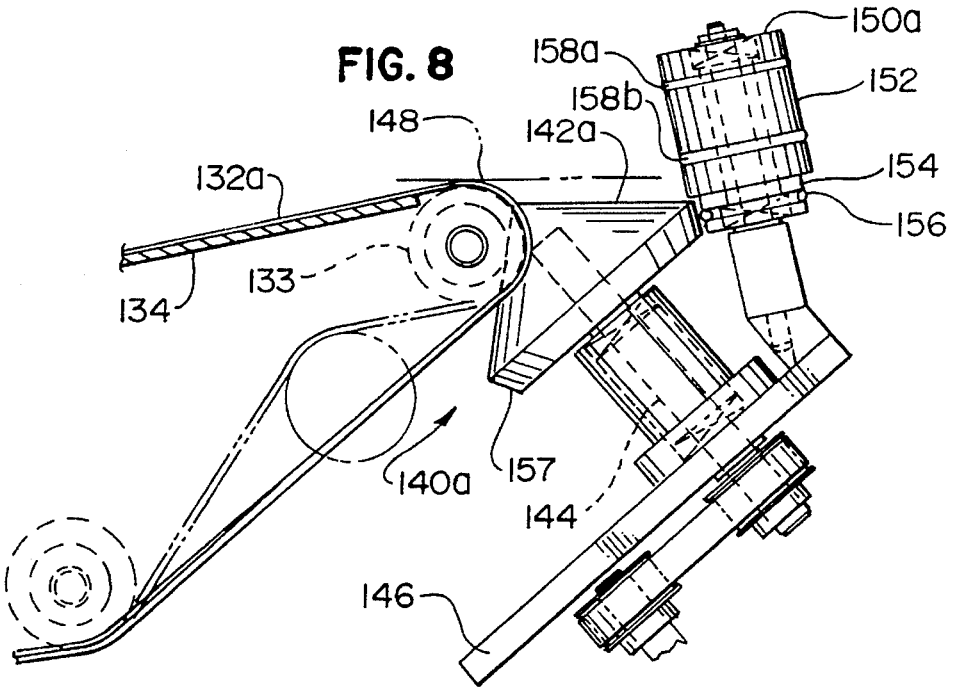
FIG. 8 is a fragmentary vertical sectional view taken substantially along line 8—8 of FIG. 7.

FIGS. 7 and 8 illustrate still another embodiment of a shingling apparatus or station, indicated generally at 130, for shingling a stack of generally upstanding on-edge documents 14 fed to the shingling station by a document conveyor or magazine 131. The document shingling apparatus 130 is operative to move successive lead documents in the stack laterally in shingled relation to a singulating station (not shown). The document feed conveyor 131 has three endless feed belts 132*a,b* and *c* which have upper reaches guided along the upper surface of an upwardly inclined base plate 134 (FIG. 8). The conveyor belts 130*a–c* are reeved about suitable drive and idler rollers 133 in similar fashion to the conveyor belts 24*a–c* and are operative to receive and feed a stack of generally upstanding on-edge documents 14 to the shingling station 130 with the documents disposed generally transverse to the conveyor belts. An upstanding vertically disposed guide plate 136 acts a guide surface against which the operator may register the upstanding left-hand margin or lead edges of the documents.

As the documents are fed to the shingling station 130 by the conveyor belts 132*a–c*, the lower marginal edges of successive documents engage a plurality of substantially identical rotatable shingling members 140*a*, 140*b* and 140*c*. The shingling members 140*a–c* are disposed in transversely aligned relation so that the lower marginal edges of the documents engage corresponding upper conical drive surfaces 142*a–c* on the shingling members substantially simultaneously. The documents advance along generally linear straight paths as they traverse the conical drive surfaces on the rotating shingling members with their lower marginal edges in tangential point contact with the conical drive surfaces.

FIG. 8 illustrates the manner of supporting the shingling member 140*a* which is representative of the shingling members 140*a–c*. The shingle member or disc 140*a* is supported on a coaxial drive shaft 144 which in turn is supported by an angularly inclined support plate 146 in similar fashion to support of the aforedescribed shingling members 52*a–e*. The drive shafts 144 of the shingling members 140*a–c* are coplanar and lie in a plane forming an included angle of approximately 40° with a vertical plane transverse to the conveyor belts 132*a–c*. The shingling members 140*a–c* have conical drive surfaces 142*a–c* defining angles of incline of approximately 40° with a plane transverse to the rotational axes of the shingling members, thus forming an included cone apex angle of approximately 100°. The shingling members 140*a–c* are positioned such that their conical drive surfaces 142*a–c* are tangent to a horizontal plane spaced slightly below a horizontal plane tangent to the conveyor belts 132*a–c* at their uppermost surfaces, as represented by phantom line 148 in FIG. 8. The shingling members 140*a–c* are positioned intermediate the conveyor belts 132*a–c* so that the lower marginal edges of documents being conveyed on the conveyor belts 132*a–c* are lowered onto the conical drive surfaces 142*a–c* and traverse the conical drive surfaces in substantially tangential point contact therewith. In similar fashion to the aforedescribed shingling members 52*a–e* and 100*a–e*, a urethane coating is applied to the conical shingling or drive surfaces 142*a–c* to cause a progressively increasing velocity component to be imparted to the lower marginal edge of each document as it traverses the conical drive surfaces 142*a–c* in tangential relation thereto. Thus, as each document traverses the shingling members 140*a–c*, it is moved laterally in its own plane at progressively increasing velocity so that its leading upstanding edge is spaced from and thereby shingled relative to the leading edge of the next successive document in the stack.

A plurality of guide rollers, three of which are indicated at 150*a,b* and *c* in FIG. 7, are operatively associated with the shingling members 140*a–c* such that the forward side surface of each successive leading document in the stack engages the guide rollers 150*a–c* and is guided thereby as the document is moved laterally in its own plane by the rotating shingling members. In the embodiment illustrated in FIGS. 7 and 8, the guide rollers 150*a–c* have generally cylindrical outer peripheral surfaces, such as indicated at 152 in FIG. 8. Each of the guide rollers 150*a–c* has a smaller diameter cylindrical surface 154 coaxial with its corresponding outer surface 152. An annular groove is formed in each annular surface 154 and receives a high friction annular drive ring, such as a rubber O-ring 156. The friction O-ring 156 on each guide roller 150*a–c* is in driving relation with an inclined annular drive surface 157 on the corresponding shingling member 140*a–c*.

The guide rollers 150*a–c* are supported for rotation about their respective longitudinal axes which lie in a common plane substantially transverse to the longitudinal axes of the conveyor belts 132*a–c*. The rotational axes of guide rollers 150*a–c* are inclined in the direction of incoming documents so as to form an included angle of approximately 10° with a vertical plane transverse to the conveyor belts 132*a–c*.

In the illustrated embodiment, a pair of additional shingling members (not shown) similar to shingling members 140*a–c* may be supported in laterally aligned relation with the shingling members 140*a–c* to receive and further shingle documents moved laterally by the shingling members 140*a–c*, in similar fashion to the shingling members 52*d* and 52*e* illustrated in FIGS. 1 and 2. Similarly, the additional pair of laterally aligned shingling members may have guide rollers associated therewith similar to the rotatably driven guide rollers 150*a–c*.

The guide rollers 150*a–c* have pairs of annular grooves formed in their outer peripheral surfaces 152 which receive endless skiving belts 158*a* and 158*b*. Rotation of the guide rollers 150*a–c* effects rectilinear movement of the skiving belts 158*a,b* which engage the forward side surfaces of successive leading documents in the stack and assist in moving the documents laterally as the documents are shingled by the shingling members 140*a–e*.

The apparatus of the various embodiments of the present invention are capable of several additional operational modes, one of which results in total separation of each document relative to a subsequent adjacent document at the end of the shingling path. By way of example, assume all discs 52*a–c*, or more discs if desired, are rotating at the same circular speed, and a one inch relative separation between successive documents is achieved for each six inches of document travel. A standard envelope is nine inches in length, thus a fifty four inch document path would be required to obtain total separation between adjacent documents at the end of the separation or shingling path. This is a substantial document path length.

To obtain total separation in a shorter document path length, the speed of each successive disc 52*a–c* can be increased relative to a preceeding disc. For example, a twenty-five percent increase in the circular or rotative speed of one disc relative to a preceding disc in a twelve inch document path will result in doubling the speed of the lead document. In a second successive twelve inch path, the speed of the lead document has doubled again. Therefore, in one embodiment of the present invention, by progressively increasing disc speed, total separation, or singulation, can be achieved in a relatively short linear distance of document travel.

Thus, in accordance with the present invention, various embodiments of a novel method and apparatus for shingling a plurality of documents disposed in stacked relation are provided. The stack of documents has at least one boundary defined by substantially coplanar marginal edges of the documents. As the stack of documents is fed along a predetermined path, the coplanar marginal edges of the documents are engaged by drive means operative to impart velocity or force components of varying and increasing magnitude to the marginal edges of the documents so as to effect relative lateral movement of the documents into a shingled array. In the preferred embodiments, the documents are arranged in an upstanding on-edge stack and are fed transversely along a path such that lower marginal edges of the documents traverse one or more rotating shingling members having substantially conical surfaces which engage the documents in point contact. The shingling members impart progressively increasing velocity components to the lower marginal edges of the documents so as to move the documents laterally at differential speeds which effect shingling between the lateral leading edges of successive documents. At the same time, the shingled array of documents is moved toward a singulation station.

While preferred embodiments of an apparatus and method for shingling generally upstanding on-edge documents has been illustrated and described, it will be understood that changes and modifications may be made therein without departing from the invention and its broader aspects. Various features of the invention are defined in the following claims.

What is claimed is:

1. Apparatus for shingling a plurality of documents disposed in stacked relation so that the stack extends successively from a first end to a second end, and has at least one boundary defined by substantially coplanar marginal edges of the documents, said apparatus comprising;

drive means for engaging said coplanar marginal edges of said documents, said drive means being operative to impart velocity components of varying magnitude to said marginal edges of said documents in a manner to effect movement of said documents into a shingled array, wherein said rotating disc means comprises at least one conical disc member rotatable about an axis inclined to a vertical plane.

2. Apparatus for shingling a plurality of documents disposed in stacked relation so that the stack extends successively from a first end to a second end, and has at least one boundary defined by substantially coplanar marginal edges of the documents, said apparatus comprising;

drive means for engaging said coplanar marginal edges of said documents, said drive means being operative to impart velocity components of varying magnitude to said marginal edges of said documents in a manner to effect movement of said documents into a shingled array wherein said drive means comprises at least one frustoconical drive member having a substantially conical drive surface adapted to engage said marginal edges of said documents, and means for feeding said stack of documents along said conical drive surface with said marginal edges of said documents in substantially tangential relation with said drive surface.

3. Apparatus for shingling a plurality of documents disposed in stacked relation so that the stack extends successively from a first end to a second end, and has at least one boundary defined by substantially co-planar marginal edges of the documents, said apparatus comprising;

means for advancing said stack of documents along a predetermined path, and drive means for engaging said co-planar marginal edges of said documents, said drive means being operative to impart velocity components of varying magnitude to said marginal edges of said documents in a manner to effect movement of said documents into a shingled array, said drive means including at least one rotating disc member having a conical drive surface operative to engage said marginal edges of said documents in point contact as said documents advance along said predetermined path and including guide roller means disposed adjacent a periphery of said conical drive surface, said documents being engaged by said guide roller means as said documents are moved into said shingled array;

said guide roller means including guide rollers which are rotatably driven to assist in moving the documents laterally in shingled relation.

4. Apparatus for shingling a plurality of documents disposed in stacked relation so that the stack extends successively from a first end to a second end, and wherein the stack has at least one boundary defined by substantially coplanar marginal edges of the documents, said apparatus comprising, in combination:

means for advancing said stack of documents along a predetermined path, and drive means for engaging said marginal edges of said documents as they are advanced along said predetermined path, said drive means being operative to impart differential velocity components to the marginal edges of said documents so as to effect relative lateral movement between said documents and establish said documents in a shingled array, wherein said document advancing means includes means to advance a stack of upstanding on-edge documents along said predetermined path with lower marginal edges of said documents substantially coplanar and transverse to said path, said drive means including at least one rotating disc member having a conical drive surface operative to engage said marginal edges of said documents in point contact as said documents advance along said predetermined path, said conical drive surface being operative to impart velocity components of increasing magnitude to said marginal edges so as to move said documents laterally in shingled relation to each other;

guide means disposed adjacent an outer periphery of said rotating disc member so that successive leading documents in said stack contact said guide means as said documents traverse said conical drive surface; and said guide means including a generally cylindrical roller adapted to be engaged by the forward surface of each successive document traversing said conical drive surface, said roller being operative to guide said documents during said lateral movement thereof.

5. Apparatus for shingling a plurality of documents disposed in stacked relation so that the stack extends successively from a first end to a second end, and wherein the stack has at least one boundary defined by substantially coplanar marginal edges of the documents, said apparatus comprising: means for advancing said stack of documents along a predetermined path; and drive means for engaging said marginal edges of said documents as they are advanced along said predetermined path, said drive means being operative to impart differential velocity components to the marginal edges of said documents so as to effect relative lateral movement between said documents and establish said documents in a shingled array, wherein said document advancing means includes means to advance a stack of upstanding on-edge documents along said predetermined path with lower marginal edges of said documents substantially coplanar and transverse to said path, said drive means including at least one rotating member wherein said rotating member defines a generally frustoconical outer peripheral drive surface and is rotatable about a substantially horizontal axis, said frustoconical drive surface being operative to engage the lower marginal edges of said documents in point contact and impart velocity components of progressively increasing magnitude to said marginal edges as said documents are advanced along said path.

6. Apparatus for shingling a plurality of documents disposed in stacked relation so that the stack extends successively from a first end to a second end, and wherein the stack has at least one boundary defined by substantially coplanar marginal edges of the documents, said apparatus comprising: means for advancing said stack of documents along a predetermined path, and drive means for engaging said marginal edges of said documents as they are advanced along said predetermined path, said drive means being operative to impart differential velocity components to the marginal edges of said documents so as to effect relative lateral movement between said documents and establish said documents in a shingled array, wherein said document advancing means includes means to advance a stack of upstanding on-edge documents along said predetermined path with lower marginal edges of said documents substantially coplanar and transverse to said path, said drive means including at least one rotating disc member having a conical drive surface operative to engage said marginal edges of said documents in point contact as said documents advance along said predetermined path, said conical drive surface being operative to impart velocity components of increasing magnitude to said marginal edges so as to move said documents laterally in shingled relation to each other, wherein said drive means includes a plurality of said rotating disc members disposed in transversely aligned relation to said predetermined path so that the lower marginal edge of each document is engaged by a plurality of conical surfaces as the document is advanced along said path; and including a generally cylindrical guide roller disposed adjacent a periphery of each of said conical drive surfaces for engagement with each successive leading document in the stack, each of said guide rollers being rotatably driven in a manner to assist in moving said documents laterally in shingled relation.

7. Apparatus for shingling a plurality of documents disposed in stacked relation so that the stack extends successively from a first end to a second end, and has at least one boundary defined by substantially coplanar marginal edges of the documents, said apparatus comprising:

means for advancing said stack of documents along a predetermined path, and drive means for engaging said coplanar marginal edges of said documents, said drive means being operative to impart velocity components of varying magnitude to said marginal edges of said documents in a manner to effect movement of said documents into a shingled array and including a plurality of said rotatable disc members disposed in transversely aligned relation to said path, said disc members having substantially conical drive surfaces operative to engage the marginal edge of successive documents in said stack and imparts a velocity component of progressively increasing magnitude to the marginal edge of each document as it traverses said drive surface said velocity component being transverse to said path and in shingled relation to each other wherein each successive rotatable disc member rotates at a circular speed greater than the circular speed of a next preceding disc member.

8. The apparatus of claim 7 wherein each document progressively advances in relative location to each subsequent adjacent document as said documents are conveyed along said path.

9. The apparatus of claim 8 wherein a leading edge of each lead document is singularly conveyed beyond a leading edge of a subsequent adjacent document as each lead document is conveyed to an output end of the apparatus.

* * * * *